US009675232B2

(12) United States Patent
Ross et al.

(10) Patent No.: US 9,675,232 B2
(45) Date of Patent: Jun. 13, 2017

(54) BOTTLE WASHER ASSEMBLY FOR DISHWASHER APPLIANCE

(71) Applicant: General Electric Company, Schenectady, NY (US)

(72) Inventors: Christopher Brandon Ross, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 303 days.

(21) Appl. No.: 14/313,057

(22) Filed: Jun. 24, 2014

(65) Prior Publication Data

US 2015/0366430 A1 Dec. 24, 2015

(51) Int. Cl.
*A47L 15/42* (2006.01)
*A47L 15/50* (2006.01)

(52) U.S. Cl.
CPC ..... *A47L 15/428* (2013.01); *A47L 15/505* (2013.01); *A47L 15/508* (2013.01)

(58) Field of Classification Search
CPC ... A47L 15/4278–15/4282; B05B 3/02; B05B 3/04
See application file for complete search history.

(56) References Cited

U.S. PATENT DOCUMENTS 4,143,821 A * 3/1979 Aghnides ..... B05B 1/083 239/381
5,316,218 A 5/1994 Bowen
2006/0090775 A1* 5/2006 De Kuyper ..... A47L 15/0055 134/25.2
2012/0291827 A1 11/2012 Buddharaju et al.

* cited by examiner

*Primary Examiner* — Jason Ko
*Assistant Examiner* — Spencer Bell
(74) *Attorney, Agent, or Firm* — Dority & Manning, P.A.

(57) ABSTRACT

Bottle washer assemblies for dishwasher appliances are provided. A bottle washer assembly includes a supply conduit defining a main passage for flowing wash fluid therethrough. The bottle washer assembly further includes at least one spray tine. The at least one spray tine includes a conduit defining a passage for flowing wash fluid therethrough, the passage in fluid communication with the main passage, and a rotatable impeller disposed within the passage.

10 Claims, 7 Drawing Sheets

BOTTLE WASHER ASSEMBLY FOR DISHWASHER APPLIANCE

FIELD OF THE INVENTION

The present subject matter relates generally to dishwasher appliances, and more particularly to bottle washer assemblies for use in dishwasher appliances.

BACKGROUND OF THE INVENTION

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, a bottle washer assembly is provided as one of the spray assemblies. The bottle washer assembly generally includes spray tines through which wash fluid is flowed. Suitable articles, such as bottles, cups, glasses, etc., are provided on the bottle washer assembly such that, for example, an article generally surrounds a spray tine. Wash fluid ejected from the spray tine contacts and cleans the inside surface of the article.

One issue with many presently known bottle washer assemblies is the stationary nature of the spray tine. Stationary jets of wash fluid are ejected from apertures defined in the spray tine, and these jets are directed to stationary locations. Accordingly, the jets only initially contact specific portions of the associated article. This can result in incomplete cleaning of the associated article.

Accordingly, improved bottle washer assemblies are desired in the art. In particular, bottle blaster assemblies that facilitate improved, more complete cleaning of associated articles would be advantageous.

BRIEF DESCRIPTION OF THE INVENTION

In accordance with one embodiment, a bottle washer assembly for a dishwasher appliance is provided. The bottle washer assembly includes a supply conduit defining a main passage for flowing wash fluid therethrough. The bottle washer assembly further includes at least one spray tine. The at least one spray tine includes a conduit defining a passage for flowing wash fluid therethrough, the passage in fluid communication with the main passage, and a rotatable impeller disposed within the passage.

In accordance with another embodiment, a bottle washer assembly for a dishwasher appliance is provided. The bottle washer assembly includes a supply conduit defining a main passage for flowing wash fluid therethrough. The bottle washer assembly further includes at least one spray tine. The at least one spray tine includes a conduit extending between a first end and a second end and defining a passage for flowing wash fluid therethrough, the passage in fluid communication with the main passage. The at least one spray tine further includes a cap defining a plurality of outlet apertures, the cap mounted to the second end of the conduit. The at least one spray tine further includes a plurality of flow paths defined in the passage, each of the plurality of flow paths rotatable within the passage to provide selective fluid communication with each of the plurality of outlet apertures.

In accordance with another embodiment, a dishwasher appliance is provided. The dishwasher appliance includes a tub defining a wash chamber, a rack assembly disposed within the wash chamber of the tub, a first spray assembly positioned adjacent the rack assembly, and a second spray assembly positioned adjacent the rack assembly. The second spray assembly is a bottle washer assembly. The bottle washer assembly includes a supply conduit defining a main passage for flowing wash fluid therethrough. The bottle washer assembly further includes at least one spray tine. The at least one spray tine includes a conduit defining a passage for flowing wash fluid therethrough, the passage in fluid communication with the main passage, and a rotatable impeller disposed within the passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
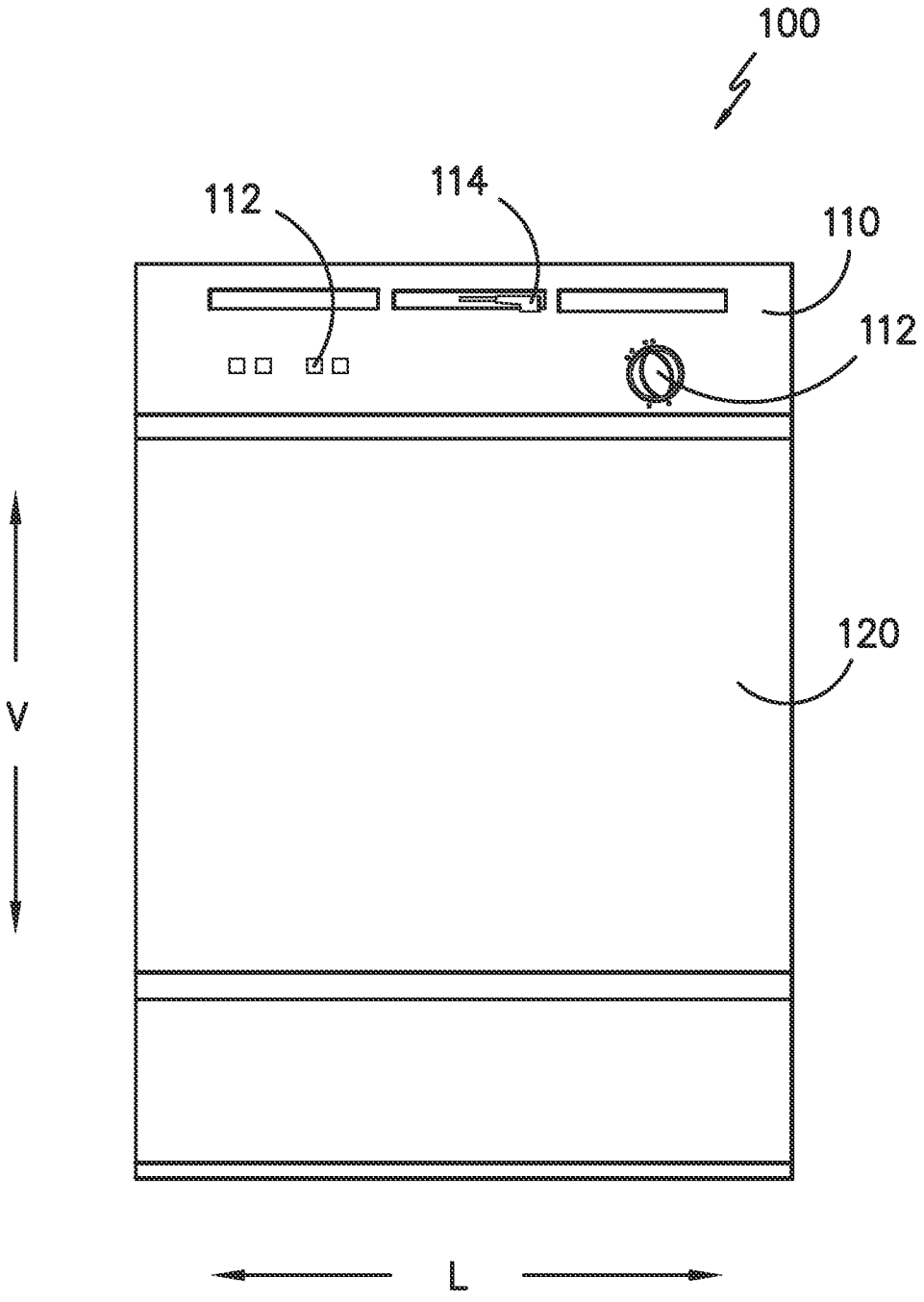
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
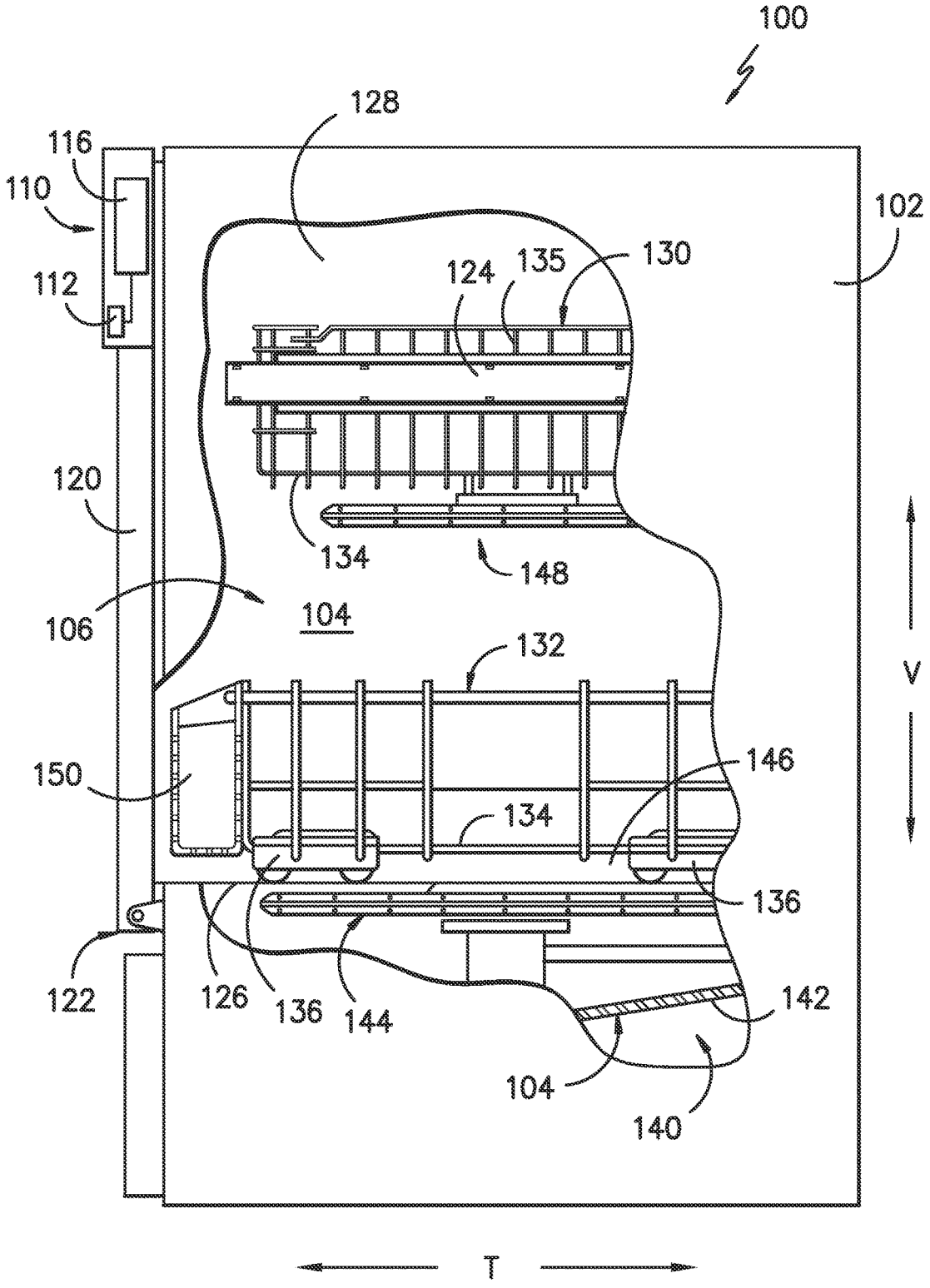
FIG. 2 provides a partial side section view of the exemplary dishwasher appliance of FIG. 1.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 and/or lower and mid-level spray assemblies 144, 148, and other differences may be applied as well.

Figure 3:
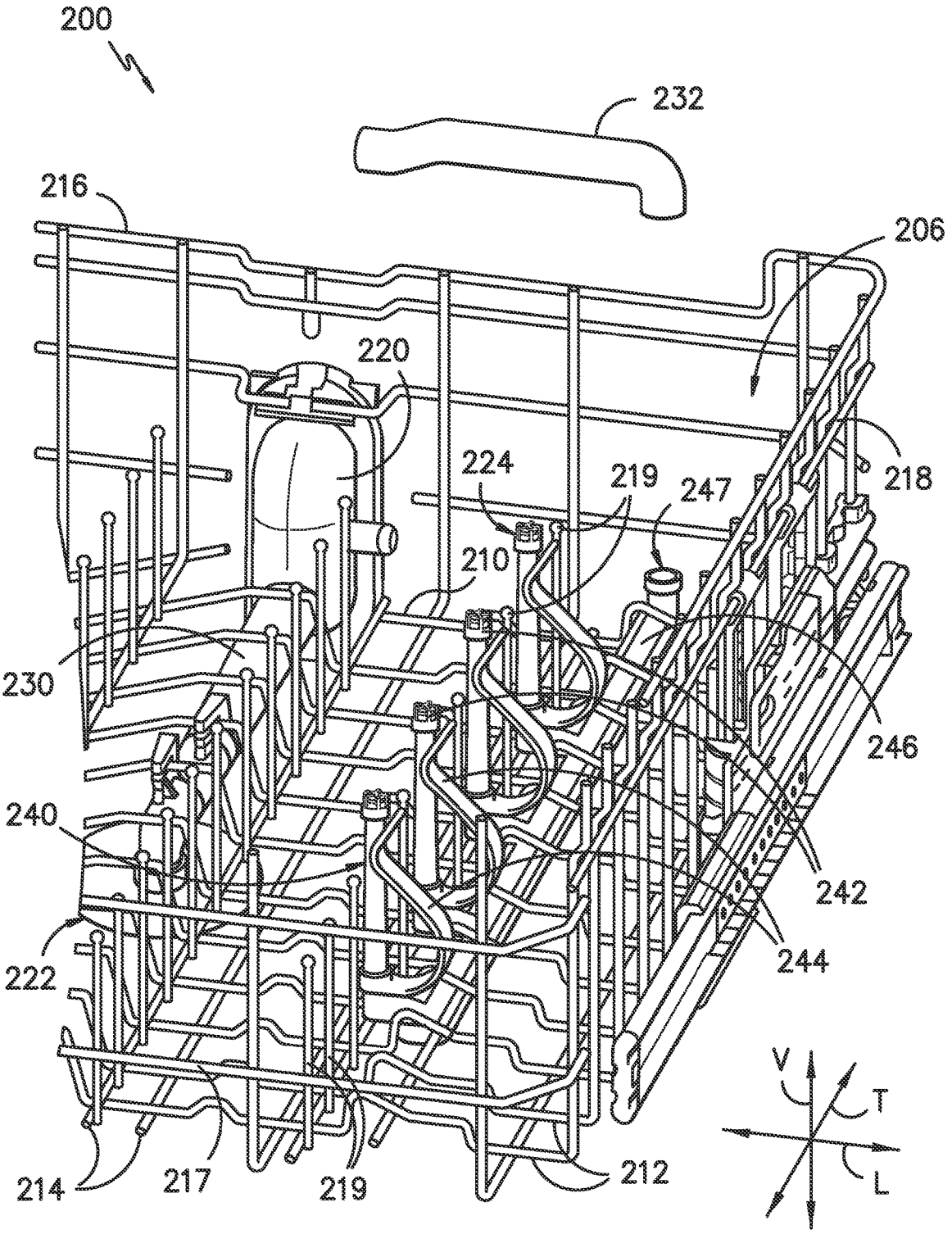
FIGS. 3 and 4 provide partial perspective views of a rack assembly according to exemplary embodiments of the present subject matter.
Figure 4:
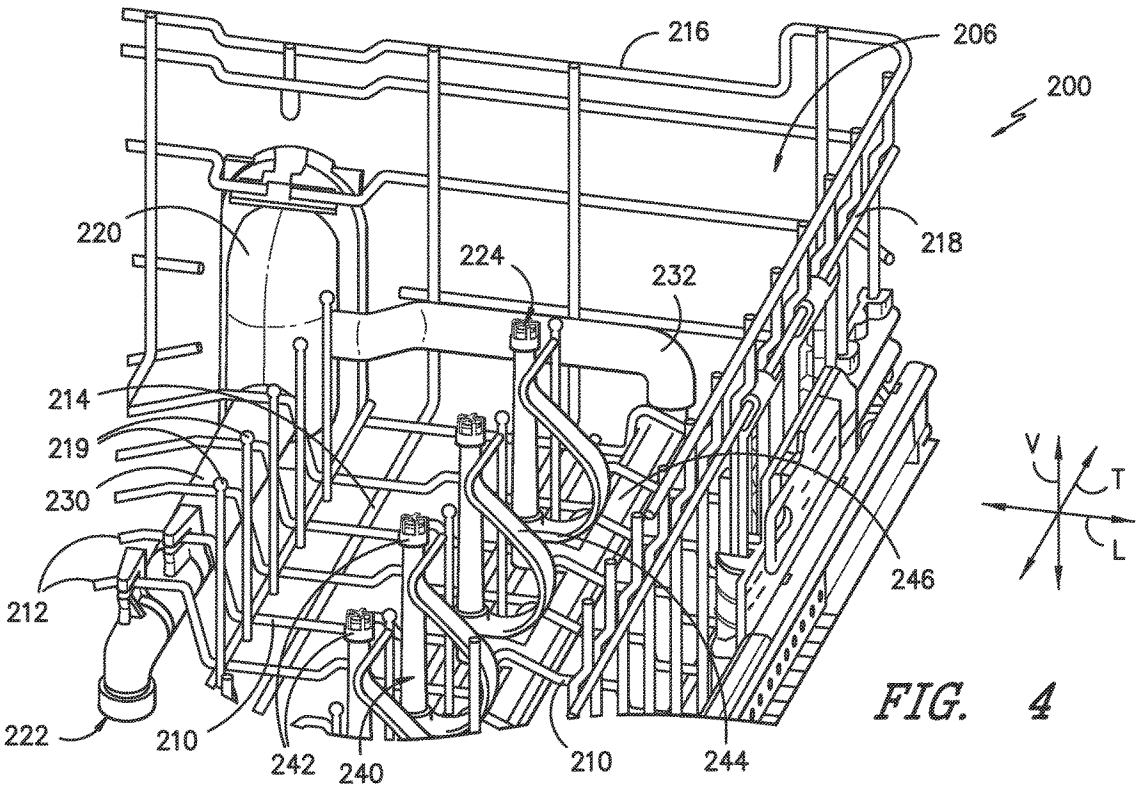

FIGS. 3 and 4 illustrate partial perspective views of a rack assembly 200 according to an exemplary embodiment of the present subject matter. Rack assembly 200 may be used in any suitable dishwasher appliance. As an example, rack assembly 200 may be utilized in dishwasher appliance 100, e.g., as upper rack assembly 130 (FIG. 2) or alternatively as lower rack assembly 132. Rack assembly 200 may generally include features for directing flows of wash fluid into the wash chamber 106, such as generally towards rack assembly 200, as discussed in greater detail below.

As may be seen in FIGS. 3 and 4, rack assembly 200 defines an interior volume 206. In particular, a bottom wall 210, a back wall 216, a front wall 217 and side walls 218 (only one of which is shown) of rack assembly 200 may assist with defining interior volume 206 of rack assembly 200. Thus, interior volume 206 of rack assembly 200 may be defined between bottom wall 210, back wall 216, front wall 217 and side walls 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 can also include a plurality of tines 219, which as shown are fixed tines but alternatively may be rotatable tines, for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIGS. 3 and 4, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

Rack assembly 200 further includes a first spray assembly 222 and a second spray assembly 224. First and second spray assemblies 222, 224 are positioned and oriented for directing respective flows of wash fluid into wash chamber 106, such as towards interior volume 206 of rack assembly 200. The flows of wash fluid from first and second spray assemblies 222, 224 can assist with cleaning articles within interior volume 206 of rack assembly 200, as will be understood by those skilled in the art. Thus, rack assembly 200 includes features for, e.g., selectively, directing multiple flows of washing fluid into interior volume 206 of rack assembly 200.

First spray assembly 222 is positioned and/or oriented for directing a first flow of wash fluid towards or into rack assembly 200. In the exemplary embodiment shown in FIGS. 3 and 4, first spray assembly 222 may be a spray arm, such as mid-level spray assembly 148 of dishwasher appliance 100. Thus, first spray assembly 222 may be a spray arm rotatably mounted to rack assembly 200 at bottom wall 210 of rack assembly 200. In particular, first spray assembly 222 may be positioned below bottom wall 210 of rack assembly 200, e.g., along the vertical direction V, and direct the first flow of wash fluid towards or into rack assembly 200 through bottom wall 210.

Second spray assembly 224 is positioned and/or oriented for directing a second flow of wash fluid towards or into rack assembly 200. In particular, as shown in FIGS. 3 and 4, second spray assembly 224 is a bottle washer assembly 240. Bottle washer assembly 240 is mounted to rack assembly 200 at bottom wall 210 of rack assembly 200. Bottle washer assembly 240 includes one or more spray tines 242. Articles, and in particulars bottles (such as baby bottles), cups, glasses, etc., may be positioned on and/or over spray tines 242. Spray tines 242 are mounted to a main conduit 246 of the bottle washer assembly 240 and extend into interior volume 206 of rack assembly 200, e.g., upwardly along the vertical direction V. In particular, spray tines 242 of bottle washer assembly 240 may be distributed between fixed tines 219 of bottom wall 210. For example, each spray tine of spray tines 242 of bottle washer assembly 240 may be positioned between respective pairs of fixed tines 219 as shown in FIGS. 3 and 4.

Spray tines 242 may assist with supporting articles within interior volume 206 of rack assembly 200. In addition, each spray tine of spray tines 242 emits a stream of wash fluid during operation of bottle washer assembly 240. The stream of wash fluid is directed against or onto an article positioned over or on each respective one of spray tines 242. In such a manner, bottles and other containers may be washed or cleaned during operation of dishwasher appliance 100.

Bottle washer assembly 240 also includes one or more clips 244. Each clip 244 is positioned and/or mounted to a respective one of spray tines 242. Clips 244 engage articles disposed on or over spray tines 242 and hinder or prevent such articles from moving during operation of bottler washer assembly 240. Thus, as an example, when a stream of fluid from one of spray tines 242 impacts a bottle disposed over the one of spray tines 242, an associated one of clips 244 hinders or prevents the bottle from being ejected off the one of spray tines 242 by the stream of fluid.

To provide wash fluid to first spray assembly 222 and second spray assembly 224, rack assembly 200 includes a supply conduit 220. Supply conduit 220 is configured for receiving wash fluid during operation of an associated dishwasher appliance 100 and directing such wash fluid to first spray assembly 222 and/or second spray assembly 224. For example, supply conduit 220 may be in fluid communication with the fluid circulation assembly of dishwasher appliance 100 when rack assembly 200 is in a closed position. Thus, the fluid circulation assembly of dishwasher appliance 100, e.g. a pump of the fluid circulation assembly, may direct wash fluid from tub sump portion 142 of tub 104 to supply conduit 220 during operation of dishwasher appliance 100.

Supply conduit 220 includes a first segment 230 that extends to or towards first spray assembly 222 and a second segment 232 that extends to or towards second spray assembly 224. First segment 230 of supply conduit 220 directs wash fluid therethrough to first spray assembly 222, e.g., during operation of dishwasher appliance 100. Second segment 232 of supply conduit 220 is configured for directing wash fluid to second spray assembly 224, e.g., during operation of dishwasher appliance 100. (It should be noted that second segment 232 is shown in an exploded position in FIG. 3 for illustrative purposes only).

Referring now to FIGS. 5 through 10, embodiments of a spray tine 242 for a bottle washer assembly 240 are illustrated. As discussed, a bottle washer assembly 240 may include one or more spray tines 242, each of which may be in fluid communication with main conduit 246, such as with a main passage 247 (see FIG. 3) defined in the main conduit 246. Wash fluid may be flowed through each spray tine 242 from the main conduit 246, and may be exhausted from each spray tine 242 generally into the wash chamber 106. Advantageously, as discussed herein, each spray tine 242 may further include rotatable features which facilitate the direction of wash fluid towards multiple different locations during operation of the dishwasher appliance 100. This provides more complete coverage of articles associated with the spray tines 242 by the wash fluid, and can thus result in improved cleaning of the associated articles.

Figure 5:
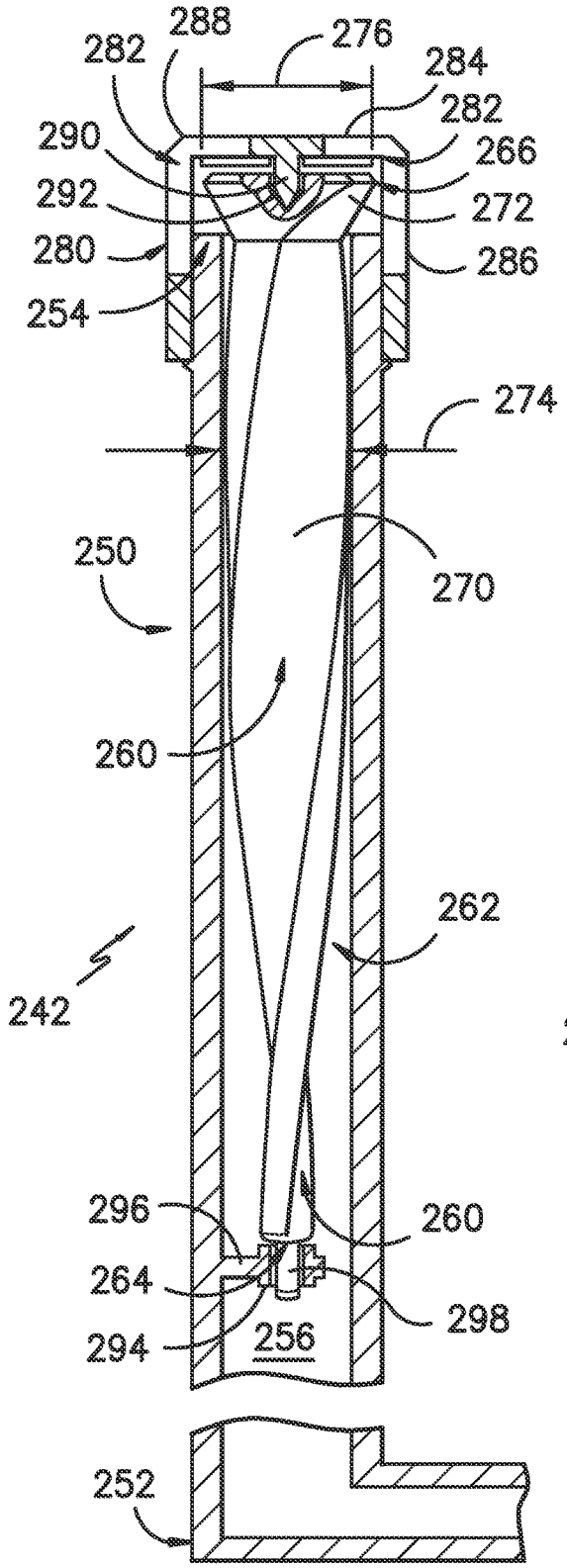
FIG. 5 provides a cross-sectional view of an upper portion of a spray tine of a bottle washer assembly according to an exemplary embodiment of the present subject matter.
Figure 6:
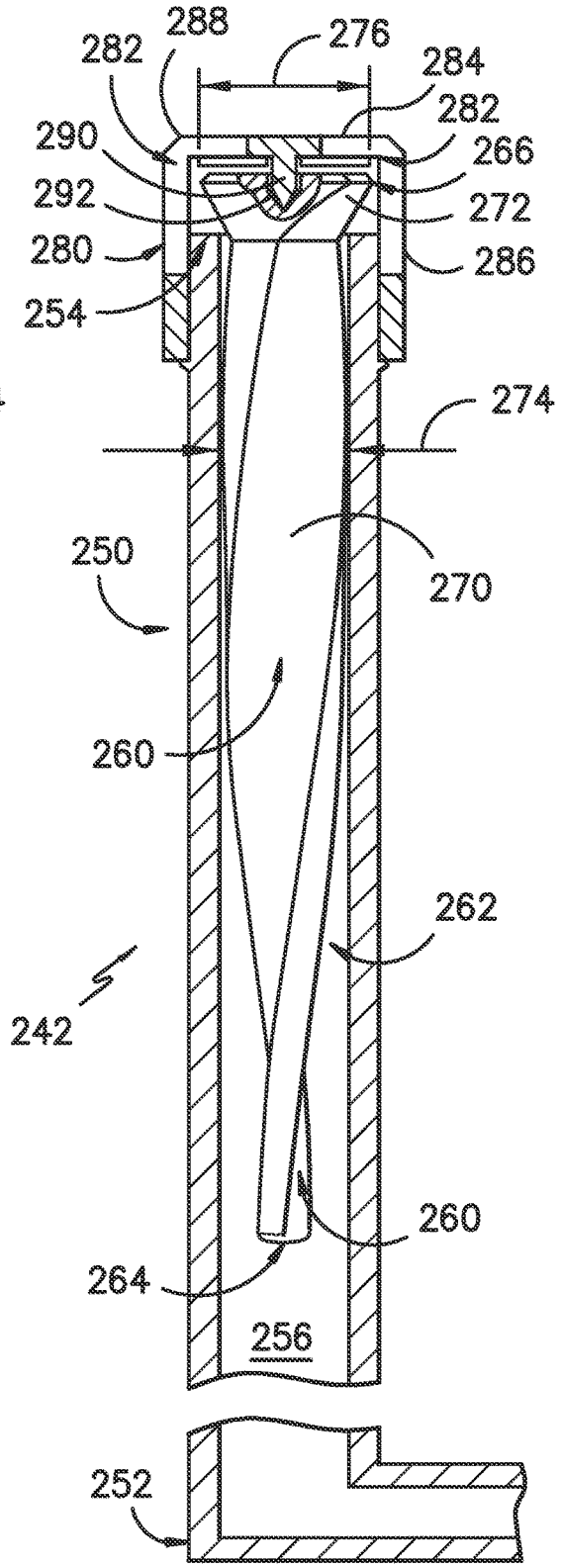
FIG. 6 provides a cross-sectional view of an upper portion of a spray tine of a bottle washer assembly according to another exemplary embodiment of the present subject matter.

As illustrated in FIGS. 5 and 6, each spray tine 242 may include a conduit 250. The conduit 250 may, for example, extend between a first end 252 and a second end 254. First end 252 may connect to the supply conduit 246, and second end 254 may be spaced from the first end 252 and supply conduit 246. Conduit 250 may further define a passage 256 extending therethrough between first end 252 and second end 254. The passage 256 may be in fluid communication with the main passage 247 of the supply conduit 246. Accordingly, wash fluid may flow from the main passage 247 into the passage 256 of each conduit 250 at the first end 252, and exit the passage 256 of each conduit 250 at the second end 254 thereof.

Figure 7:
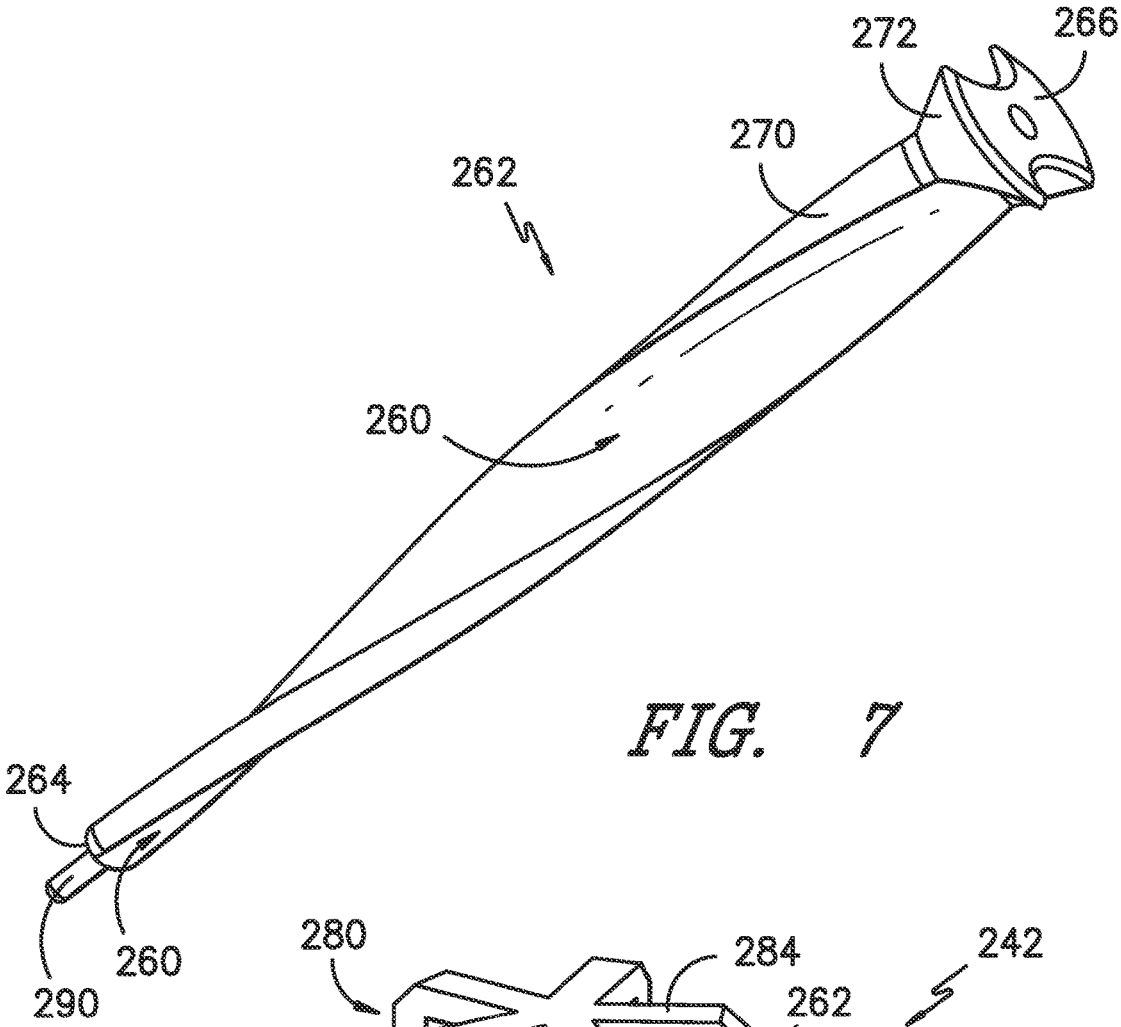
FIG. 7 provides a perspective view of an impeller for use in a spray tine of a bottle washer assembly according to an exemplary embodiment of the present subject matter.

As shown in FIGS. 5, 6 and 7, one or more flow paths 260 may be defined in the passage 256 of each conduit 250. In exemplary embodiments, for example, two flow paths 260 may be defined in the passage 256. Alternatively, however, one, three, four or more flow paths 260 may be defined in the passage 256. In exemplary embodiments, the flow paths 260 may each be helical, and may thus extend helically in a direction from the first end 252 towards the second end 254 within the passage 256. Further, advantageously, each of the plurality of flow paths 260 may be rotatable within the passage 256. For example, the flow paths 260 may be rotatable about a central longitudinal axis defined by the conduit 250. Such rotation may result in distribution of wash fluid flowed through the flow paths 260 towards multiple locations, resulting in improved cleaning of associated articles.

In exemplary embodiments as shown, each spray tine 242 may include an impeller 262. The impeller 262 may be disposed within the passage 256, and may advantageously be rotatable within the passage 256, such as about the central longitudinal axis. The impeller 262 may extend between a first end 264 and a second end 266 within the passage 256. Further, the flow paths 260 may be defined by the impeller 262. For example, channels or other suitable surfaces may be defined in the passage 256 to form the flow paths 260. Wash fluid may thus flow past the impeller 262 through the flow paths 260.

As illustrated, in some embodiments, impeller 262 may include a body 270 and a head 272. The body 270 may include the first end 264, and the head 272 may include the second end 266. In exemplary embodiments, the head 272 may, for example, taper from the second end 266 towards the body 270. Further, in exemplary embodiments as illustrated, a maximum diameter 276 of the head 272 may be greater than a maximum diameter 274 of the body 270. The size and shape of the head 272 may advantageously direct the flow of wash fluid in flow paths 260 towards the outlet apertures 282 of a cap 280 included on the spray tine 242.

As illustrated in FIGS. 5 through 10, a spray tine 242 may further include a cap 280. The cap 280 may be mounted to the conduit 250, such as to the second end 254 thereof. Cap 280 may further define a plurality of outlet apertures 282 through which wash fluid may be exhausted from the spray tine 242 into the wash chamber 106. Accordingly, wash fluid may flow from the second end 254 of the conduit into the cap 280, and from the cap 280 into the wash chamber 106 through the outlet apertures 282.

Advantageously, the flow paths 260 and impeller 262 defining the flow paths 260 may be rotatable within the passage 256 to provide selective fluid communication with each of the plurality of outlet apertures 282. For example, rotation of the flow paths 260 (and impeller 262) may cause each flow path 260 to periodically, during rotation, be aligned with an outlet aperture 282 of the plurality of outlet apertures 282. During this alignment, wash fluid may be flowed to and through that outlet aperture 282 from the associated flow path 260. Further, due the movement of the flow paths 260, wash fluid can be flowed in various directions through the outlet aperture 282. A full rotation of a flow path 260 may result in alignment with, and thus wash fluid flow through, each outlet aperture 282 of a plurality of outlet apertures 282.

Figure 8:
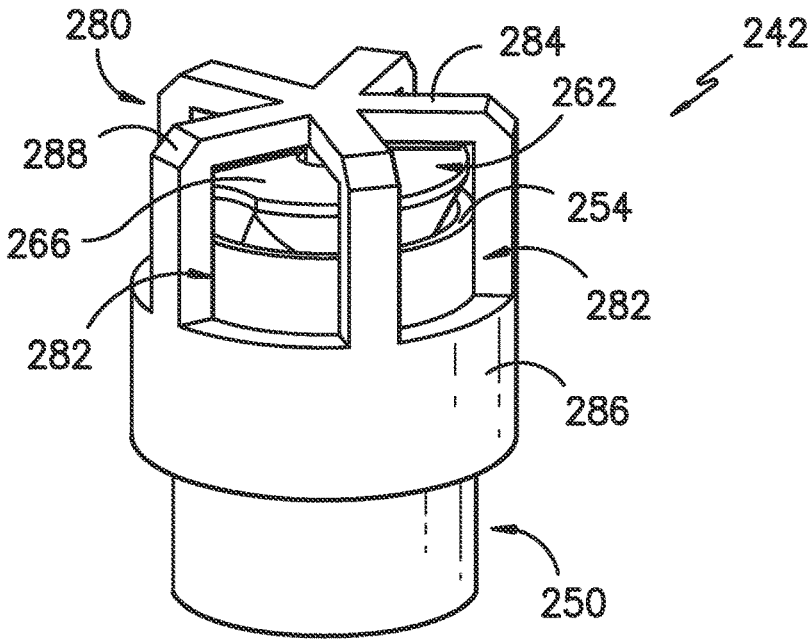
FIG. 8 provides a top perspective view of a spray tine of a bottle washer assembly according to an exemplary embodiment of the present subject matter.
Figure 9:
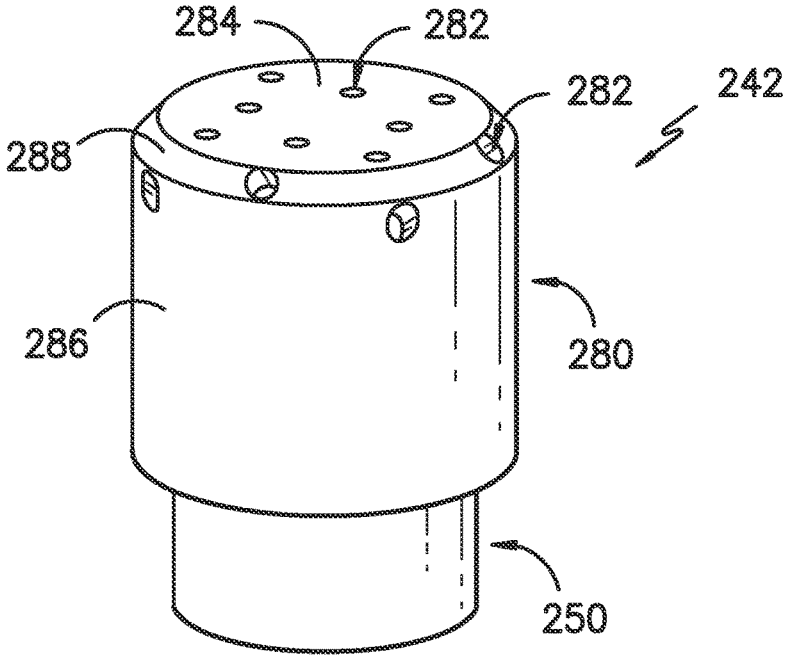
FIG. 9 provides a top perspective view of a spray tine of a bottle washer assembly according to another exemplary embodiment of the present subject matter.
Figure 10:
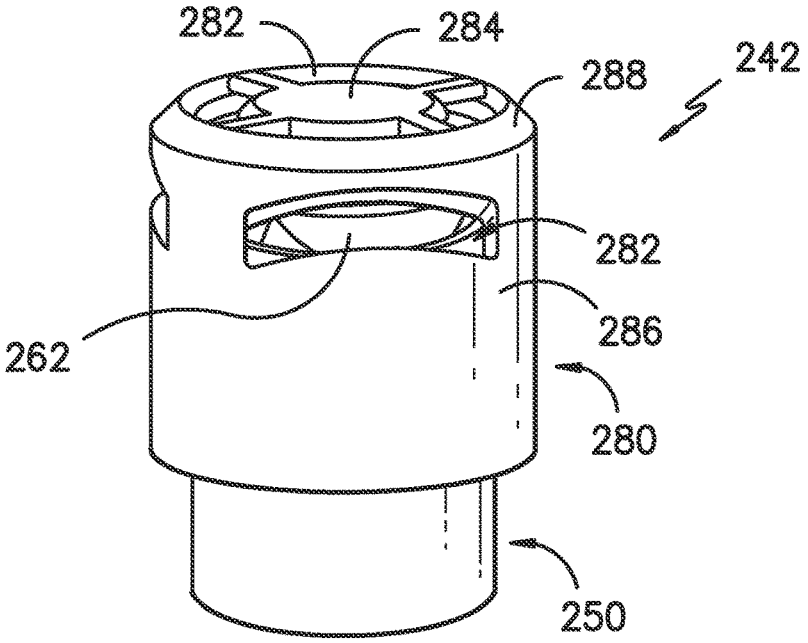
FIG. 10 provides a top perspective view of a spray tine of a bottle washer assembly according to yet another exemplary embodiment of the present subject matter.

Any suitable number of outlet apertures 282, of any suitable size and shape, may be utilized for a cap 280. For example, cap 280 may include a top wall 284 and one or more side walls 286. Optionally, a chamfered edge 288 may be provided between the top wall 284 and side wall(s) 286. As illustrated in FIG. 8, an array of outlet apertures 282 may be defined in cap 280, and each aperture 282 may be defined in the top wall 284, one or more side walls 286, and the optional chamfered edge 288. Alternatively, as illustrated in FIGS. 9 and 10, each aperture 282 may be discretely defined in one of the top wall 284, a side wall 286, or the chamfered edge 288. In some embodiments as illustrated in FIG. 9, one or more of the apertures 282 may be generally circular. In other embodiments as illustrated in FIG. 10, one or more of the apertures 282 may be generally arcuate.

Referring again to FIGS. 5 and 6, the impeller 262 may be rotatably mounted within the spray tine 242. In some embodiments as shown, the second end 266 of the impeller 262 may be rotatably mounted to the cap 280. For example, as shown in FIGS. 5 and 6, a mounting protrusion 290 may extend from the second end 266, and may be inserted within a mounting recess 292 defined in the cap 280 (such as in the top wall 284 thereof). Alternatively, mounting protrusion 290 may extend from the cap 280 (such as the top wall 284 thereof), and mounting recess 292 may be defined in the second end 266. The protrusion 290 may be rotatable and generally movable within the recess 292 to facilitate rotation of the impeller 262.

Further, in some embodiments, as shown in FIG. 5, the first end 264 of the impeller 262 may be rotatably mounted to the conduit 250. For example, a basket 294 may be disposed within the passage 256, and may be connected to the conduit 250 via an arm 296. A protrusion 298 may extend from the first end 264, and may be inserted within the basket 294. The protrusion 298 may be rotatable and generally movable within the basket 294 to facilitate rotation of the impeller 262. Alternatively, a protrusion may be disposed within the passage 256, and a recess may be defined in the first end 264, and the protrusion may be rotatably inserted within the recess. In other alternative embodiments, as illustrated in FIG. 6, first end 264 of impeller 262 may be free within passage 256, and may thus not be rotatably mounted to the conduit 250.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher rack comprising a bottle washer assembly for a dishwasher appliance, the bottle washer assembly comprising:

a supply conduit defining a main passage for flowing wash fluid therethrough;

and at least one spray tine, the at least one spray tine comprising:

a conduit defining a passage for flowing wash fluid therethrough, the passage in fluid communication with the main passage;

a cap defining a plurality of outlet apertures; and a rotatable impeller disposed within the passage, wherein the impeller comprises a body and a head, the head having a maximum diameter greater than a maximum diameter of the body, the head being tapered from the maximum diameter of the head towards the body above the passage defined by the conduit such that the head is prevented from passing into the conduit, wherein the head is disposed within the cap, wherein the body is disposed within the conduit, and wherein the rotatable impeller defines a plurality of generally helical flow paths for wash fluid flow past the impeller.

2. The dishwasher rack of claim 1, wherein the impeller extends between a first end and a second end, and wherein the first end is rotatably mounted to the conduit.

3. The dishwasher rack of claim 1, wherein the impeller extends between a first end at the body and a second end at the head, and wherein the second end is rotatably mounted to the cap.

4. The dishwasher rack of claim 1, further comprising at least one clip.

5. The dishwasher rack of claim 1, wherein the at least one spray tine is a plurality of spray tines.

6. A dishwasher appliance, comprising:

a tub defining a wash chamber;

a rack assembly disposed within the wash chamber of the tub;

a first spray assembly positioned adjacent the rack assembly; and a second spray assembly positioned adjacent the rack assembly, wherein the second spray assembly is a bottle washer assembly, the bottle washer assembly comprising:

a supply conduit defining a main passage for flowing wash fluid therethrough; and at least one spray tine, the at least one spray tine comprising:

a conduit defining a passage for flowing wash fluid therethrough, the passage in fluid communication with the main passage;

a cap defining a plurality of outlet apertures; and a rotatable impeller disposed within the passage, wherein the impeller comprises a body and a head, the head having a maximum diameter greater than a maximum diameter of the body, the head being tapered from the maximum diameter of the head towards the body above the passage defined by the conduit such that the head is prevented from passing into the conduit, wherein the head is disposed within the cap, wherein the body is disposed within the conduit, and wherein the rotatable impeller defines a plurality of generally helical flow paths for wash fluid flow past the impeller.

7. The dishwasher appliance of claim 6, wherein the bottle washer assembly further comprises at least one clip.

8. The dishwasher appliance of claim 6, wherein the impeller extends between a first end and a second end, and wherein the first end is rotatably mounted to the conduit.

9. The dishwasher appliance of claim 6, wherein the impeller extends between a first end and a second end, and wherein the second end is rotatably mounted to the cap.

10. The dishwasher appliance of claim 6, wherein the at least one spray tine is a plurality of spray tines.

* * * * *